US008120508B2

(12) United States Patent
Madhavan et al.

(10) Patent No.: US 8,120,508 B2
(45) Date of Patent: Feb. 21, 2012

(54) CABLE LINK FOR A WELLBORE TELEMETRY SYSTEM

(75) Inventors: Raghu Madhavan, Houston, TX (US); David Santoso, Sugar Land, TX (US); Lise Hvatum, Katy, TX (US)

(73) Assignee: IntelliServ, LLC, Houston, TX (US)

( * ) Notice: Subject to any disclaimer, the term of this patent is extended or adjusted under 35 U.S.C. 154(b) by 1453 days.

(21) Appl. No.: 11/648,109

(22) Filed: Dec. 29, 2006

(65) Prior Publication Data

US 2008/0159077 A1 Jul. 3, 2008

(51) Int. Cl.
*G01V 3/00* (2006.01)

(52) U.S. Cl. ..... 340/853.1; 175/5.57; 166/358; 439/194

(58) Field of Classification Search ..... 175/5, 57; 166/358; 439/194
See application file for complete search history.

(56) References Cited

U.S. PATENT DOCUMENTS 4,057,781 A 11/1977 Scherbatskoy
4,095,865 A 6/1978 Denison et al.
4,220,381 A * 9/1980 van der Graaf ..... 340/853.7
4,319,240 A * 3/1982 Stone et al. ..... 340/855.1
4,770,034 A 9/1988 Titchener et al.
4,806,115 A 2/1989 Chevalier et al.
4,806,928 A 2/1989 Veneruso
4,828,051 A * 5/1989 Titchener et al. ..... 340/855.2
4,901,069 A 2/1990 Veneruso
5,235,285 A 8/1993 Clark et al.
5,348,492 A * 9/1994 Sonnet ..... 439/194
6,670,880 B1 12/2003 Hall et al.
6,776,233 B2 8/2004 Meehan
6,801,135 B2 * 10/2004 Schultz et al. ..... 340/853.1
7,040,415 B2 5/2006 Boyle et al.
2003/0029641 A1 * 2/2003 Meehan ..... 175/57
2004/0094303 A1 5/2004 Brockman et al.
2004/0119607 A1 6/2004 Davies et al.
2004/0168794 A1 9/2004 Vold
2007/0029112 A1 * 2/2007 Li et al. ..... 175/26
2008/0066960 A1 * 3/2008 Mathiszik et al. ..... 175/41
2010/0116550 A1 * 5/2010 Hutin et al. ..... 175/40

* cited by examiner

*Primary Examiner* — Timothy Edwards, Jr.
(74) *Attorney, Agent, or Firm* — Conley Rose, P.C.

(57) ABSTRACT

A cable link may include a first link connector in signal communication with at least one sensor in a drill string and coupled to the drill string, a second link connector spaced apart from the first link connector and in signal communication with a telemetry system, the second connector link coupled to the drill string, and a linking cable having signal connectors at each end thereof, the linking cable having at least one of an electrical conductor and an optical fiber therein, the signal connectors each configured to latch proximate a respective one of the first and second link connector.

18 Claims, 9 Drawing Sheets

CABLE LINK FOR A WELLBORE TELEMETRY SYSTEM

BACKGROUND OF THE INVENTION

1. Field of the Invention

The invention relates generally to the field of telemetry systems used for instruments disposed in a wellbore during the drilling thereof. More particularly, the invention relates to "wired" drill pipe power and telemetry communication systems.

2. Background Art

Wellbores are drilled through subsurface Earth formations for, among other purposes, extracting useful materials such as petroleum. Typically drilling techniques include disposing drilling tools such as a drill bit, drill collars, jars, stabilizers and other devices at the end of a number of segments ("joints") of threadedly coupled pipe. The pipe is suspended and rotated at the surface by a drilling rig. Drilling fluid is pumped through an interior passage way in the pipe and is discharged at the bottom of the wellbore through nozzles or similar orifices in the drill bit to circulate drill cuttings out of the wellbore and to cool and lubricate the drill bit.

It is known in the art to include in the foregoing drilling tools a number of sensing devices, collectively known as "measurement while drilling" and "logging while drilling" instruments for the purpose of measuring such things as the direction and inclination of the drill bit, the temperature and pressure near the drill bit, as well as various physical parameters of the Earth formations penetrated by the wellbore. Measurements made by the foregoing instruments are typically stored in a recording device, such as a solid state memory, disposed in one or more of such instruments. Certain of the measurements are also transmitted to the surface by one or more telemetry devices, such as a mud-pulse telemetry device that modulates the flow of the drilling fluid to create signals in the mud flow.

The measurements made by the foregoing instruments can be quite valuable when transmitted to the surface during the drilling of a wellbore. For example, measurements of physical properties of the subsurface formations may indicate to the wellbore operator that particular subsurface formations are about to be penetrated. Where such penetration may require particular preparation, advance information may prevent expensive damage to the wellbore or other drilling hazards. Such measurements may also be made at a time when there is little mud invasion of the formation, making the measurements more accurate. Other examples of useful information transmitted to the surface may include measurements concerning motion of the drilling tools in the wellbore. Such measurements can indicate that the drilling tool assembly is undergoing destructive vibration, or is moving in a manner such that much of the energy supplied by the drilling rig is dissipated rather than being used to drill the subsurface formations.

The above described systems have at best been able to transmit signals to the surface at several bits per second. Obtaining information about the subsurface formations in sufficient detail and information concerning the drilling tool movement may require signal transmission rates several orders of magnitude greater than is possible conventional telemetry. Such requirement has been long recognized by the petroleum industry, and a number of different "wired" drill pipe systems have been proposed. See, for example, U.S. Pat. No. 4,806,115 issued to Chevalier, et al., and U.S. Pat. No. 4,095,865 issued to Dennison, et al. More recently, wired drill pipe including inductive couplers between joints of pipe has been proposed. See U.S. Pat. No. 6,670,880 issued to Hall, et al. Using electrical and/or optical conductors arranged with the drill pipe may enable transmission of signals at much higher rates than is possible using mud pulse telemetry.

Irrespective of the type of wired drill pipe system used, most drilling tool assemblies include devices such as described above including jars, drill collars, stabilizers, etc. Such devices are frequently disposed in the drilling tool assembly between the drill pipe and the lower part of the drilling tool assembly where the sensing devices referred to above are typically located. In order to provide signal communication using wired drill pipe across tools such as jars, drill collars, and stabilizers, it would be necessary to provide structures in such tools that are compatible with the particular type of wired drill pipe system used. Having wiring structures in the foregoing drilling tools is difficult and expensive, particularly because such drilling tools as subject to frequent repair to the threaded connectors at each longitudinal end.

There exists a need for a wired drill pipe system than can be used with ordinary drilling tools such as collard, jars, stabilizers and the like that do not have wiring structures therein.

It is also desirable to provide a "wired" connection between instruments in the wellbore and surface equipment, in order to provide a high-bandwidth communication channel between such instrument and surface equipment.

SUMMARY OF THE INVENTION

A cable link according to one aspect of the invention includes a first link connector in signal communication with at least one sensor in a drill string and coupled to the drill string, a second link connector spaced apart from the first link connector and in signal communication with a telemetry system, the second connector link coupled to the drill string, and a linking cable having signal connectors at each end thereof, the linking cable having at least one of an electrical conductor and an optical fiber therein the signal connectors each configured to latch proximate a respective one of the first and second link connector.

A drill string telemetry system according to another aspect of the invention includes a wired drill pipe, a first telemetry module coupled at one end to an end of the wired drill pipe, the first telemetry module in signal communication with the wired drill pipe, the first telemetry module including a latch, at least one drilling tool coupled at one end to the other end of the first telemetry module, a second telemetry module coupled at the other end of the at least one drilling tool, the second telemetry module having a second latch, the second telemetry module coupled at its other end to one end of a while drilling instrument and in signal communication therewith, and a linking cable connected to the first and second telemetry module.

A method for assembling a cable link to a drill string according to another aspect of the invention includes coupling a first link connector to a drill string to be in signal communication with at least one sensor in the drill string, coupling one end of at least one drilling tool to the first link connector, the at least one drilling tool having no signal communication feature therein, coupling a second link connector to the other end of the at least one drilling tool, inserting a linking cable having a first and a second signal connector at the ends thereof into an interior of the second link coupling and extending the linking cable through the interior until the first signal connector seats in the first link coupling, winding the cable by rotating the second signal connector to as to cause the cable to frictionally contact an interior surface of the at least one drilling tool, and seating the second signal connector in the second link connector.

A telemetry system according to another aspect of the invention includes a first link connector in signal communication with at least one instrument coupled to a drill string disposed in a wellbore, a second link connector coupled to the drill string and spaced apart from the first link connector, the second link connector in signal communication with equipment disposed at the Earth's surface, and a linking cable having signal connectors at each end thereof, the linking cable having at least one of an electrical conductor and an optical fiber therein, the signal connectors each configured to latch proximate a respective one of the first and second link connector.

A method for assembling a cable link to a drill string in accordance with another aspect of the invention includes coupling a first link connector to a drill string to be in signal communication with at least one instrument in the drill string, coupling the at least one instrument to be in signal communication with the first link connector, coupling a second link connector to the drill string at a location proximate the Earth's surface, inserting a linking cable having a first and a second signal connector at the ends thereof into an interior of the second link coupling and extending the linking cable through the interior until the first signal connector seats in the first link coupling, winding the cable by rotating the second signal connector to as to cause the cable to frictionally contact an interior surface of the at least one drilling tool, and seating the second signal connector in the second link connector.

A method of transmitting data according to another aspect of the invention includes collecting data, transmitting the data from a first device to a first linking connector, transmitting the data from the first linking connector to a first signal connector, transmitting the data along a cable from the first signal connector to a second signal connector, and transmitting the data from the second signal connector to a second linking connector.

Other aspects and advantages of the invention will be apparent from the following description and the appended claims.

DETAILED DESCRIPTION

Figure 1:
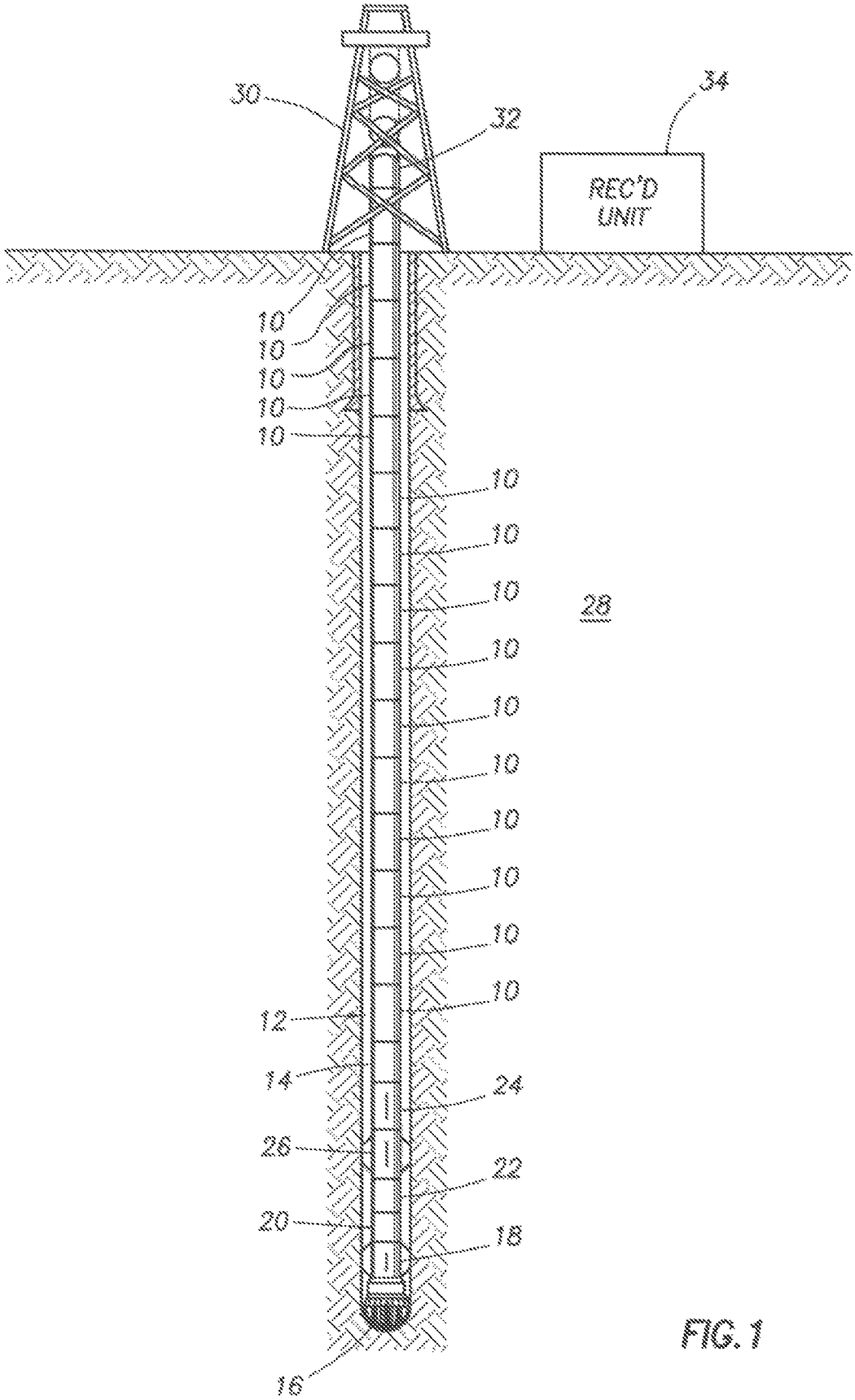
FIG. 1 shows an example of a drilling tool assembly suspended by a drilling rig drilling a wellbore through Earth formations.

The general setting in which a cable link according to the invention is used will be explained with reference to FIG. 1. A drilling rig 30 or similar apparatus suspends a "drill string" in a wellbore 12 being drilled through various subsurface Earth formations 28. The drill string includes a drill bit 16 at the lower end. The drill bit 16 may rotated by equipment (not shown separately) on the drilling rig 30, or may alternatively or additionally be rotated by a drilling motor (not shown) disposed in the drill string. Part of the weight of the drill string is transferred to the drill bit 16 by suspending the drill string appropriately by the drilling rig 30, and the combination of the transferred weight and rotation causes the drill bit to drill through the subsurface formations 28.

There are two general configurations of a cable link described herein. One is used to bypass a drilling tool that is not susceptible to inclusion of signal communication devices within its housing. The bypass may form a link between various instruments in the drill string and a wired drill pipe, as will be further explained below with reference to FIG. 1. The other configuration uses a cable link to establish signal communication between a drilling instrument and equipment at the Earth's surface. Such other configuration will be explained on more detail with reference to FIGS. 8A, 8B and 9.

Returning to FIG. 1, the drill string may include one or more logging while drilling and/or measurement while drilling devices having one or more sensors disposed proximate or above the drill bit 16. For example, a "resistivity at bit" sensor 18 may be coupled proximate the drill bit 16. Such sensors make measurements corresponding to the electrical resistivity of the formations penetrated by the drill bit 16. One embodiment of such a resistivity at bit sensor is described in U.S. Pat. No. 5,235,285 issued to Clark, et al. and assigned to the assignee of the present invention. Other while-drilling sensors may include drilling direction sensors, and other logging while drilling sensors of types well known in the art, all shown generally at 20. The while drilling sensors are generally enclosed in high strength, non-magnetic housings including threaded connections at the longitudinal ends thereof to enable threaded coupling within the drill string. While the present example is explained in terms of sensors, other instruments such a directional drilling controls, formation fluid sampling devices, and any other device that can be controlled or operated by signals and/or which generates signals usable by a system operator or any device at the Earth's surface may be used with various implementations of a cable link according to the invention.

A first link connector module 22, which can also be threadedly coupled to the drill string, may be disposed at the upper end of the logging while drilling and/or measurement while drilling instruments. The first link connector module 22 includes components, to be explained in more detail below, that enable transferring signals generated by the various logging while drilling and/or measurement while drilling instruments in the drill string below to an electrical and/or optical linking cable (not shown in FIG. 1). Signals may also be communicated to the various while drilling instrument for operational control thereof. The linking cable (not shown in FIG. 1) extends from the first link connector module 22 to a second link connector module 14.

The second link connector module 14 in the present example is typically disposed at the upper end of a set of conventional drilling tools that do not have associated wiring or other device for transferring signals and/or electrical power therethrough. Such conventional drilling tools may include, for example, a bladed stabilizer 26 and drilling jars 24. The second link connector module 14 includes components therein (not shown in FIG. 1) for receiving the signals sent along the linking cable (not shown in FIG. 1) and coupling the received signals to electrical and/or optical conductors (not shown in FIG. 1) in a "wired" drill pipe string, shown in FIG. 1 as joints of wired drill pipe 10 threadedly coupled end to end and extending upward in the wellbore 12 to the drilling rig 30. The second link connector module 14 may also transfer signals in the opposite direction, from the wired drill pipe string to the linking cable 44 and to the first connector module 22 for eventual detection by the while drilling instruments.

As used in the present description, the term "wired drill pipe" means any type of drill pipe or pipe string that includes some form of electrical and/or optical signal communication channel. Such pipe may include separate insertable elements that have insulated electrical conductors, wherein the ends of the conductors in each joint of pipe include terminations that make electrical contact with corresponding terminations in the adjacent joint of pipe. One such electrical contact configuration is shown in U.S. Pat. No. 4,806,115 issued to Chevalier, et al., and another is shown in U.S. Pat. No. 4,095,865 issued to Dennison, et al. "Wired drill pipe" as used herein also includes pipe having inductive couplers between joints of pipe as shown in U.S. Pat. No. 6,670,880 issued to Hall, et al. Accordingly, the type of connection between the conductors in adjacent joints of pipe is not intended to limit the scope of the invention. Using one or more optical fibers and corresponding joint by joint connectors in association with drill pipe is also within the meaning of "wired drill pipe" as used in the present description.

A signal communication device 32 may be coupled to the upper end of the wired drill pipe 10. The signal communication device 32 may be any device that can detect signals transmitted along the wired drill pipe string and transfer the detected signals to a recording unit 34 located at the Earth's surface for storage and/or interpretation. The signal communication device 32 may, for example, include a wireless transceiver for communicating signals. The communication device 32 may alternatively include an inductive coupling to transfer signals from the device 32 to a pick up coil (not shown) suspended proximate the device 32. The communication device 32 may alternatively or additionally include slip rings (not shown) or other rotatable contact device to enable rotation of the communication device 32 and transfer of signals therefrom to a rotationally fixed position. The signal communication device is used to enable the drill string to rotate while maintaining communication between the recording unit 34 and the signals transmitted along the wired drill pipe.

For purposes of defining the scope of this example of the invention, it is only necessary that the wired drill pipe 10 include some form of electrical and/or optical conductor that is capable of carrying signals. Some embodiments of wired drill pipe may include electrical conductors that can transmit electrical power from the surface to the various instruments in the drill string, however such is not a limit on the scope of what has been invented. In the present description, signal communication is generally described in terms of signals being transmitted upwardly from the various sensors in the lower part of the drill string for eventual detection at the surface and recording and/or interpretation in the recording unit 34. It should be understood, and as previously explained, that the signal communication components described herein can also be capable of transmitting signals in the opposite direction, such as would be the case for control signals transmitted from the recording unit 34 to operate the instruments in the wellbore 12 in a particular manner. Therefore, any reference to signal communication herein is intended to include within its scope movement of signals in either direction along the drill string.

One example of a cable link according to the invention will now be explained with reference to FIG. 2. FIG. 2 shows the lowermost components of the drill string shown in FIG. 1 in more detail, including the drill bit 16, the resistivity at bit sensor 18, the directional (and other measurement and/or logging while drilling sensors) sensor 20, the first link connector module 22, the stabilizer 26, drilling jar 24, second link connector module 14, and the lowermost joint of wired drill pipe 10. As explained above, the drill string defines an interior passage 50 therethrough for flow of drilling fluid that ultimately is discharged through nozzles 16A in the drill bit 16. The interior passage 50 also provides space for a linking cable 44 that may provide signal and/or electrical power between the first link connector module 22 and the second link connector module 14.

Figure 2:
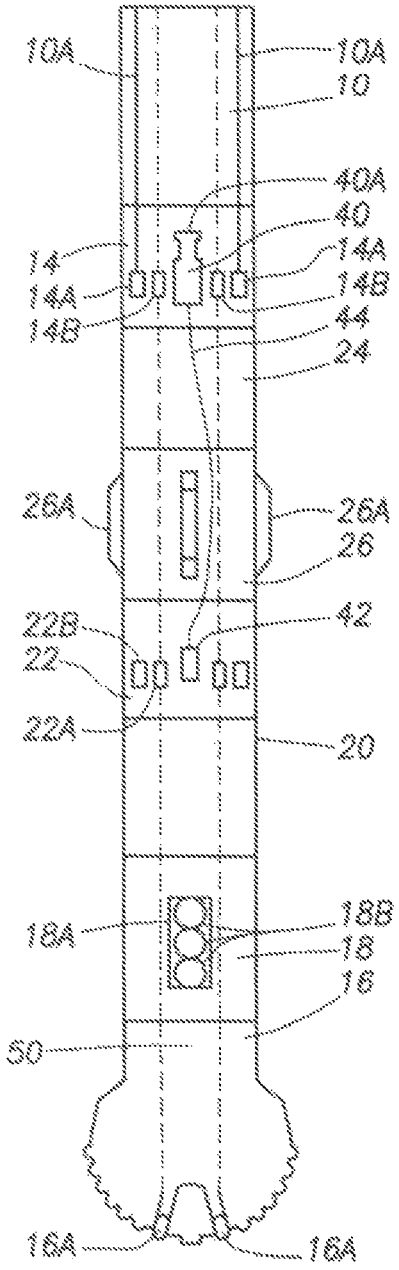
FIG. 2 shows an example of a bottom hole assembly including one embodiment of a cable link according to the invention.

As will be appreciated by those skilled in the art, the resistivity at bit sensor 18 may include one or more blades 18A on its exterior surface arranged to contact the wall of the wellbore (12 in FIG. 1). The one or more blades 18A may include a plurality of contact electrodes 18B to measure voltages impressed on the formations (28 in FIG. 1) by various electrical and/or electromagnetic power sources (not shown). It should be understood that the example while drilling instruments shown in FIGS. 1 and 2 are only examples of the various types of sensing devices that can be used with a cable link according to the invention.

The linking cable 44 includes a first connector 42 at its lower end. The first connector 42 is configured to seat in a latch 22A in the interior of the first link connector module 22. The first connector 42 includes features (not shown in FIG. 2) configured to detect signals from a first signal coupling 22B disposed generally proximate the latch 22A inside the first connector link module 22. The first signal coupling 22B is in signal communication with the various while drilling sensors in the drill string, including for example, the directional sensor 20 and the resistivity at bit sensor 18. Such signal communication may be performed by any form of internal logging while drilling signal bus as will be familiar to those skilled in the art.

Signals imparted to the linking cable 44 through the first connector 42 are moved along one or more optical and/or electrical conductors (not shown separately in FIG. 2) in the linking cable 44. When the signals reach the upper end of the linking cable 44 they are transferred to the second link connector module 14 using a second connector 40 that may be seated or locked in a second latch 14B inside the second link connector module 14. The second link connector module 14 may include a second signal coupling 14A disposed proximate the second latch 14B. The second signal coupling 14A is configured to couple to one or more electrical and/or optical conductors 10A in the wired drill pipe 10.

The second connector 40 may include a fishing neck 40A or similar feature at its upper end configured to engage a corresponding tool (not shown) such as an "overshot" or grapple to enable retrieval of the linking cable 44 in certain circumstances. For example, in the event one or the other of the link connector modules 22, 14 fails during operation, or if the one or more electrical and/or optical conductors 10A in the wired drill pipe 10 fails, the linking cable 44 may be removed from the interior of the drill string, and a data linking coupling (not shown) may be lowered into the drill string by a cable (not shown) and latched proximate the first latch 22B to transfer stored signals from the sensors to the Earth's surface. One device for enabling such signal transfer is described in U.S. Pat. Nos. 4,806,928 and 4,901,069 issued to Veneruso and assigned to the assignee of the present invention.

Figure 3B:
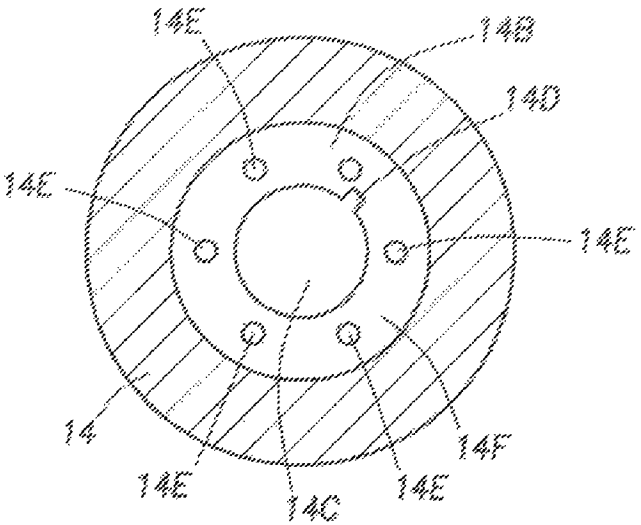
FIGS. 3A through 3C show one example of a link connector module.
Figure 3C:
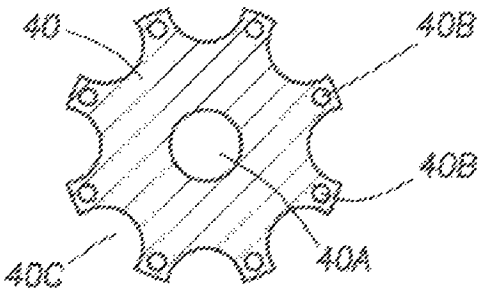
Figure 3A:
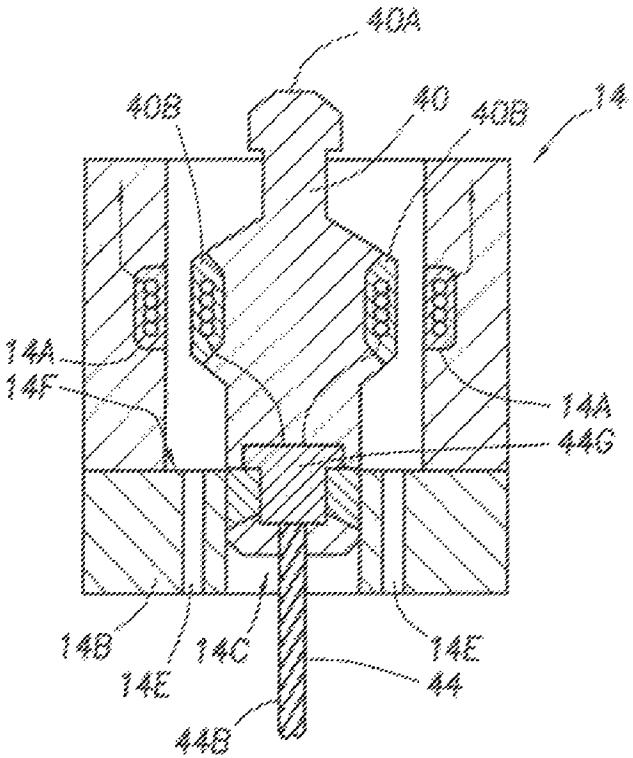

One example of the second link connector module 14 is shown in cut away view in FIG. 3A. The example shown in FIG. 3A is for the second link connector module 14, however the general structure as shown in FIG. 3A may also be used for the first link connector module (22 in FIG. 2). The second link connector module 14 may be made from non-magnetic, high strength alloy such as monel, or an alloy sold under the trademark INCONEL, which is a registered trademark of Huntington Alloys Corporation, Huntington, W.Va. The second signal coupling 14A may be in the form of a wire coil disposed in a corresponding slot, recess or channel in the interior wall of the second link connector module 14. The second latch 14B may be in the form of a landing 14F or ledge disposed inside the module 14. The landing 14F preferably includes one or more passageways 14E for the flow of drilling fluid through the landing 14F. The second connector 40 is shown such that its lowermost portion, in the form of an extension, is seated in a corresponding opening 14C in the landing 14F. The second connector 40 may also be made from non-magnetic high strength alloy and includes therein one or more wire coils 40B forming part of an electromagnetic inductive coupling. The other part of the inductive coupling includes the wire coils inside the second link connector module 14. The wire coils 14B inside the second connector 40 may be electrically coupled to insulated electrical conductors 44A forming part of the linking cable 44. The linking cable 44 may be conventional armored electrical cable familiar to those skilled in the art of electric wireline logging of wellbores. Such cables include one or more such insulated electrical conductors 44A surrounded by helically wound armor wires 44B. The armor wires may be terminated in a load transferring device familiar to those skilled in the art known as a "rope socket" and shown generally at 44C. The rope socket 44C may seat in a corresponding feature inside the second connector 40.

A top view of the interior of the second link connector module 14 is shown in FIG. 3B. The landing 14F extends generally laterally from the inner wall of the module 14 to the opening 14C. The opening 14C may include a key slot 14D or similar indexing feature to maintain the second connector 40 in a fixed rotational position in the opening 14C when it is seated therein. The view in FIG. 3B also shows a plurality of circumferentially spaced apart passages 14E to enable flow of drilling fluid through the landing 14F when the second connector 40 is seated therein.

In some implementations the first connector (42 in FIG. 2) will have a maximum diameter small enough to pass through the opening 14C in the second link connector module 14. Thus, to install the linking cable 44 with its attached first 42 and second 40 connectors, the assembled lower portion of the drill string, including all the components shown in FIG. 2 other than the first joint of wired drill pipe 10 are hung in the drilling rig (30 in FIG. 1), and the linking cable 44 is inserted into the interior of the second link connector module 14. The first connector 42 with cable 44 attached is lowered through the opening (14C in FIG. 3B) in the landing (14F in FIG. 3B) until the first connector 42 seats in a corresponding landing (not shown) in the first link connector module 22. The cable 44 has a length sufficient to enable winding the cable 44 by twisting the second connector 40. By winding the cable 44, the cable will have a tendency to unwind, thus fixing it by friction against the interior wall of the stabilizer 24 and jars 26. The second connector 40 is then seated in the second link connector module 14. The wired drill pipe 10 is then threadedly coupled to the upper end of the second link connector module 14 and is lowered into the wellbore (12 in FIG. 1).

As will be readily appreciated by those skilled in the art, electromagnetic coupling between the coil in the second connector module 14 and the coils in the second connector 40 will be more efficient if the corresponding coils are placed in close proximity when the connector 40 is seated in the module 14. Such proximity would, absent certain features in the module and/or the connector, limit the amount of annular space to enable flow of drilling fluid. A possible configuration of the second connector 40, shown in FIG. 3C includes a plurality of recesses 40C in the exterior surface configuration of the second connector 40 to enable passage of drilling fluid or other fluid. The coils 40B are shown in the portions of the second connector 40 intended to be disposed proximate the coil 14A in the second module 14 when the second connector 40 is seated in the second module 14. Other configurations to enable fluid flow will be explained below with reference to FIGS. 5, 6 and 7.

The first connector 42 and the second 40 connector are described above as having features for electromagnetic signal coupling, and the linking cable 44 is described as having insulated electrical conductors. It will be appreciated by those skilled in the art that direct contact (galvanic) coupling to electrical conductors may be used additionally or alternatively. Such galvanic couplings may be in the form of submersible connectors as will be explained in more detail below. In other examples, one or more optical couplings may be used, and the linking cable 44 may include one or more optical fibers.

Figure 4B:
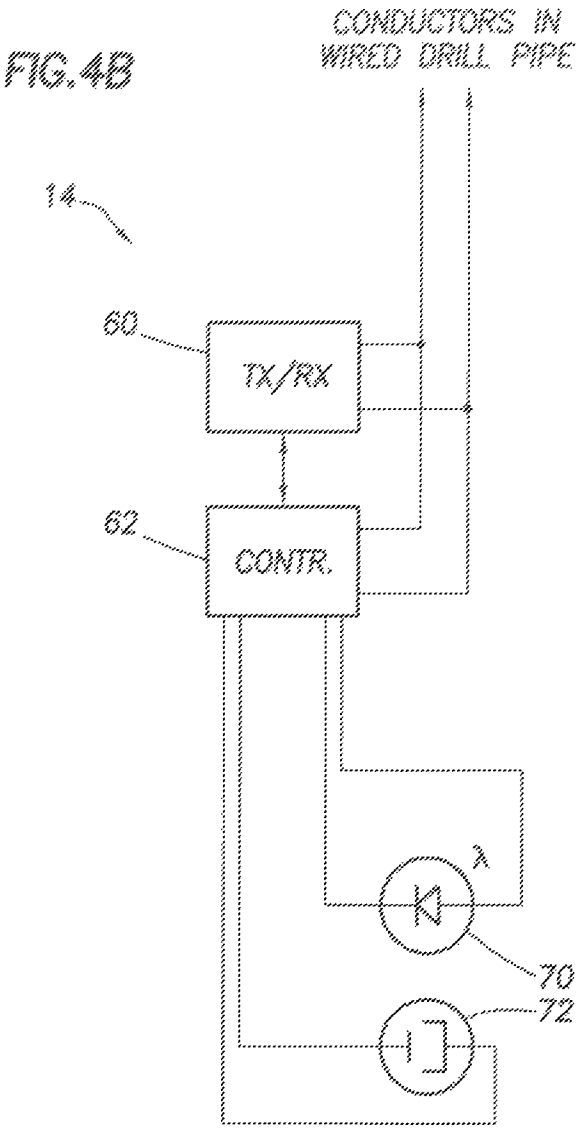
FIG. 4B shows an example of an optical implementation of the second link connector module.
Figure 4A:
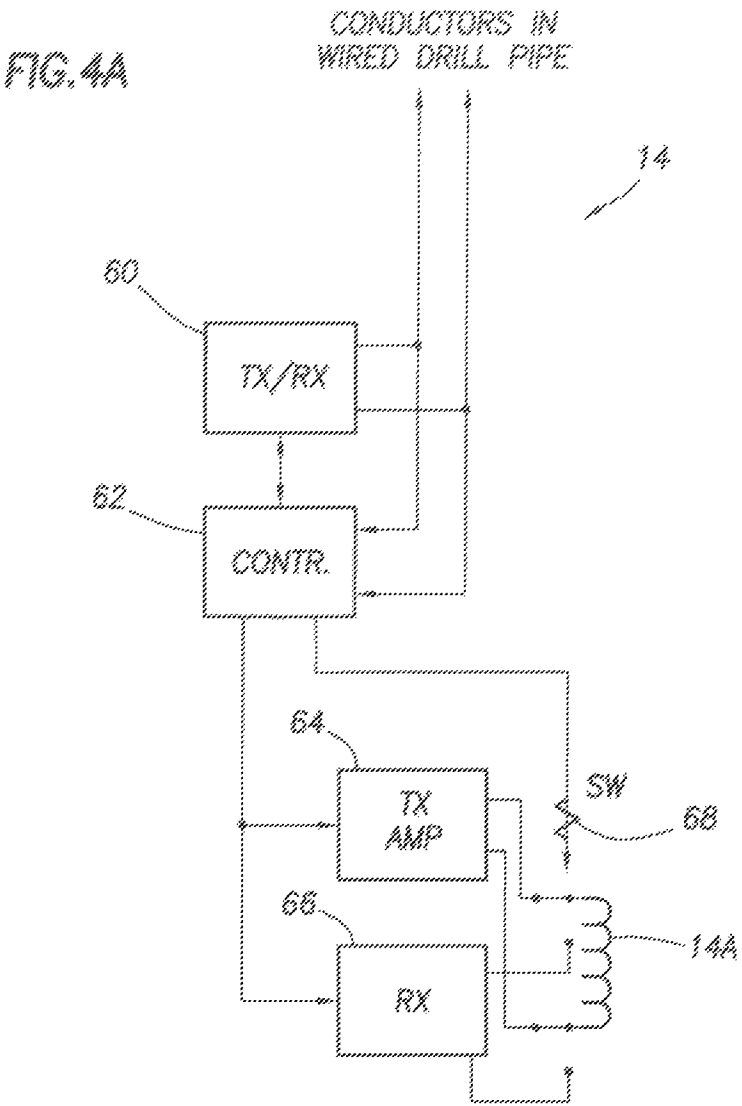
FIG. 4A shows an example of an electromagnetic implementation of the second link connector module.

FIG. 4A shows one example of control circuitry in the second link connector module 14 that uses electromagnetic induction to communicate signals from the module 14 to the linking cable (44 in FIG. 2). A signal transceiver 60 is in signal communication with the electrical conductors in the wired drill pipe (10 in FIG. 1). The electrical conductors in the wired drill pipe can also carry electrical power to operate the transceiver 60 and a controller 62, which can be a microprocessor-based controller. Command signals transmitted from the recording unit (34 in FIG. 1) can be detected by the transceiver 60 and decoded in the controller 62. For commands that are to be transmitted to the sensors (18, 20 in FIG. 2) in the lower part of the drill string, such commands can be formatted into suitable telemetry by the controller 62 and sent to a transmitter amplifier or transmitter driver 64. Output of the transmitter driver 64 can be coupled through a controller-operated transmit/receive switch 68 to the induction coil 14A. Correspondingly, signals sent along the linking cable (44 in FIG. 2) can be detected in a receiver 66 coupled through the switch 68 to the induction coil 14A. Detected sensor signals may be processed for telemetering to the surface by the controller 62, which ultimately conducts the signals to the transceiver 62 for application to the conductors in the wired drill pipe.

An alternative embodiment is shown in FIG. 4B which includes a photodiode 70 functionally coupled to the controller for generating optical telemetry, and a photodetector 72 functionally coupled to the controller 62 for detecting optical telemetry from the linking cable, where optical coupling is used.

Although the scope of this invention is not so limited, it is contemplated that electrical power for the sensors (18, 20 in FIG. 2) in the drill string may be provided by batteries (not shown) disposed therein, or by a fluid driven turbine (not shown) rotating an electrical alternator (not shown), as will be familiar to those skilled in the art. It is within the scope of this invention for electrical power to be transmitted from the Earth's surface along the wired drill pipe (10 in FIG. 1), through the cable link such as using the embodiment shown in FIG. 2 having electromagnetic induction coupling, or galvanic coupling.

Figure 5:
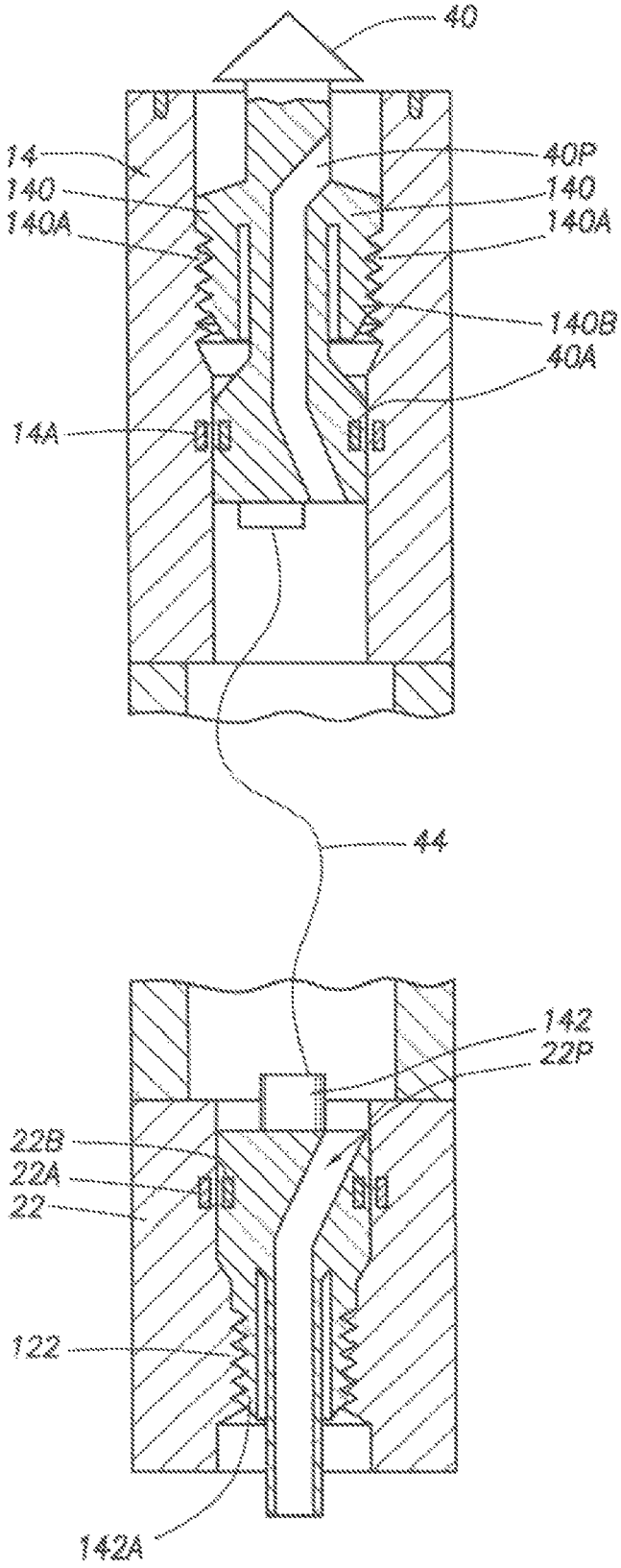
FIG. 5 shows examples of link connector modules.

Another example of a cable link is shown in FIG. 5. Such example may include different forms of latching to retain the connectors in their respective modules. In FIG. 5, the second (upper) connector module 14 may include dogs 140A or similar engagement devices on the interior surface thereof. Such dogs 140A are configured to cooperatively engage corresponding dogs 140B on the exterior surface of collets 140 formed into or attached to the exterior of the second connector 40. In the present embodiment, the second connector 40 may include a generally centrally disposed fluid passage 40P to enable flow of drilling fluid or other fluid through the interior of the pipe string when it is in the wellbore. The second connector module 14 may be located in the pipe string in the wellbore as explained with reference to FIG. 1, or as will be further explained, may be located in the pipe string proximate the Earth's surface.

The first connector module 22 may also includes dogs 122 on its inner surface. The first connector 142 may include corresponding dog surfaces on collets 142A that cooperatively engage the dogs 142 when the first connector 142 is seated in the first connector module 22. Similarly to the second connector 140, in the present example, the first connector 142 may include a fluid passage 22P to enable fluid flow through the connector 142 when it is seated in the first connector module 22. Electrical and/or optical connection may be made between the respective connectors 40, 42 and modules 14, 22 substantially as explained above with reference to FIG. 3A. For example, signal couplings 14A and 40A may from inductive coils that provide an inductive connection.

Figure 6:
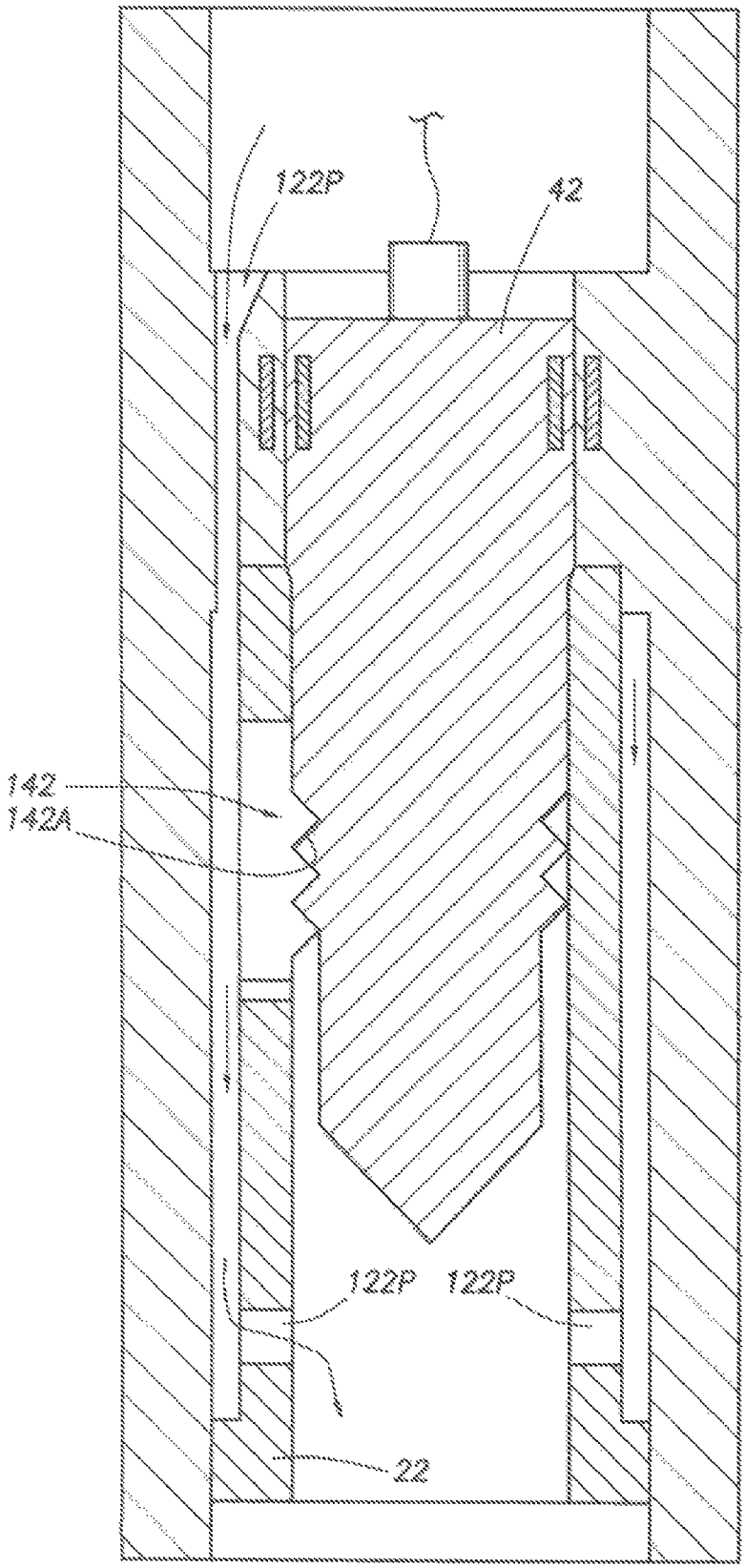
FIG. 6 shows an example of a link connector module.

As shown in FIG. 6, in some examples, a fluid flow passage 122P may be included in the wall of the first connector module 22, as an alternative to or in addition to the fluid flow passage (22P in FIG. 5) in the first connector 42. A similar arrangement of annular flow passage (not shown) may be provided for the second connector and second connector module (40 and 14, respectively in FIG. 3A).

Figure 7:
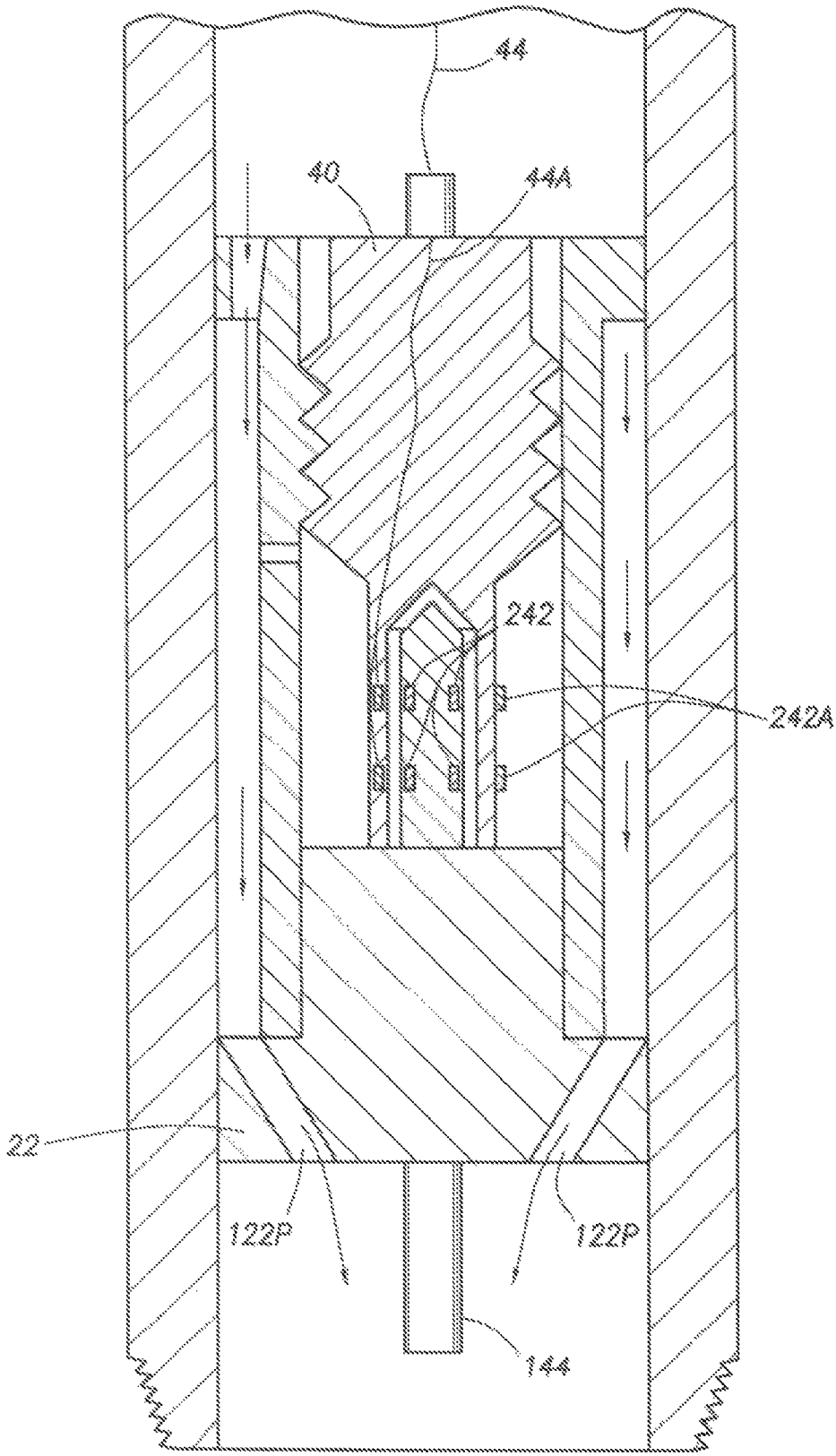
FIG. 7 shows an example of a link connector module.

FIG. 7 shows a "wet contact" type of electrical or optical connection between the first connector 42 and the first connector module 22. In the example shown in FIG. 7, electrical or optical conductors 44A in the linking cable 44 may be terminated in contacts 242A inside a female portion of a wet connector. The male portion of the wet connector is disposed in the connector module 22. Such wet connectors are known in the art, and are sold, for example by Kemlon Products and Development, Pearland, Tex. When the first connector 42 is seated in the first connector module 22, the contacts 242A in the wet connector female portion are placed into contact with corresponding contacts 242 disposed in the male portion in the first connector module 22. The corresponding contacts 242 may be coupled to one or more electrical and/or optical conductors (not shown separately in FIG. 7) in a lower cable 144. The lower cable 144 may be electrically, optically and/or mechanically coupled to instrumentation disposed in the pipe string as explained with reference to FIG. 2. The first connector module 22 may in some examples include fluid flow passages 122P. The implementation shown in FIG. 7 may also be used for the second connector (40 in FIG. 3A) and second connector module (14 in FIG. 2) in some examples. In another example, the contacts 242, 242A may form inductive coils that form an inductive connection. Other types of connections are known in the art.

Another example implementation of a cable link according to the various aspects of the invention will now be explained with reference to FIGS. 8A and 8B. The implementation shown in and explained with reference to FIG. 2 provides a link between certain instruments or devices in the drill string across a drilling tool such as a jar or stabilizer that was not susceptible to implementation with wired drill pipe. The linking cable was therefore relatively short, and the first and second connector modules and respective connectors were therefore disposed proximately on opposed sides of the "non-wired" drilling tool. In the embodiment shown in FIG. 8A, however, the first connector module 22 may be disposed proximate to and in signal communication with a drilling instrument 23 that may be disposed near the bottom of the drill string. The drilling instrument 23 may be any device known in the art that can be coupled within a drill string and that makes measurements of one or more subsurface parameters and/or accepts control signals to operate one or more types of instruments. The drilling instrument therefore may include, as non limiting examples, rotary steerable directional drilling systems, measurement while drilling tools, logging while drilling tools, formation sampling tools, formation pressure testing tools, adjustable stabilizers, etc. and any combinations of the foregoing. The first connector module 22 may be structured according to any of the examples explained above, and may include a first connector (not shown for clarity) latchably inserted therein as explained above. The first connector (not shown) may be coupled to a linking cable 44 as explained above.

In the present example, the second connector module 14, with second connector therein (not shown separately) is coupled in the drill string proximate the Earth's surface. The second connector module 14 may include a first wireless transceiver 114. The first wireless transceiver 114 may provide signal communication between signals transmitted over the linking cable to and from the drilling instrument 23 to a second wireless transceiver 116. The second wireless transceiver 116 may be mounted in any convenient position such that transceived signals may be communicated to the recording unit 34. The purpose of the two transceivers 114, 116 is to enable signal communication between the rotating drill string and the stationary recording unit 34.

Figure 9:
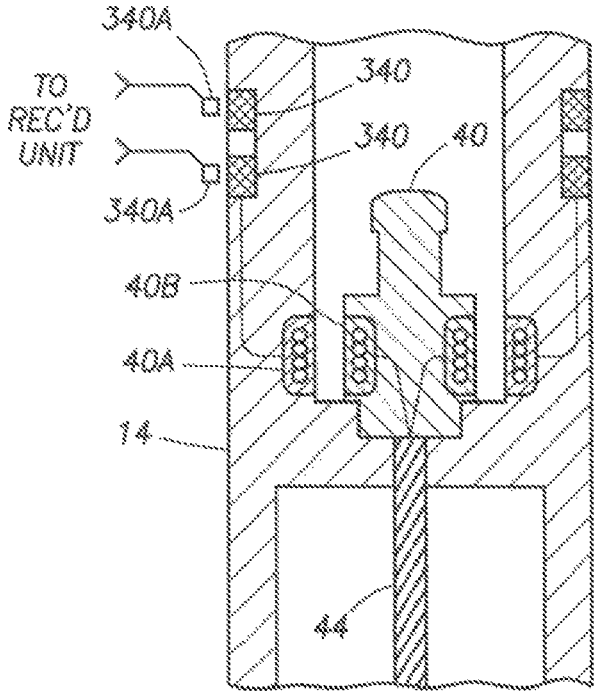
FIG. 9 shows an example of a link connector module.

An alternative to using wireless transceivers is shown in FIG. 9. The second connector module 14 may include electrical and/or optical slip rings 340 formed in an exterior surface of the module 14. Electrical and/or optical fixed contacts 340A may be placed in contact with the slip rings 340 to enable communication of signals between the fixed contacts 340A and the slip rings 340.

Referring back to FIG. 8A, it will be apparent that the linking cable 44 extends from the drilling instrument 23 to a position proximate the Earth's surface. Using such a linking cable 44 and with such placement of the second connector module 14, it is possible to provide signal communication from the instrument 23 near the bottom of the wellbore to the Earth's surface in substantially the same manner as if the instrument 23 were coupled to the recording unit 34 using a "wireline", or armored electrical or optical cable extending from the recording unit 34 all the way to the drilling instrument 23.

Figure 8A:
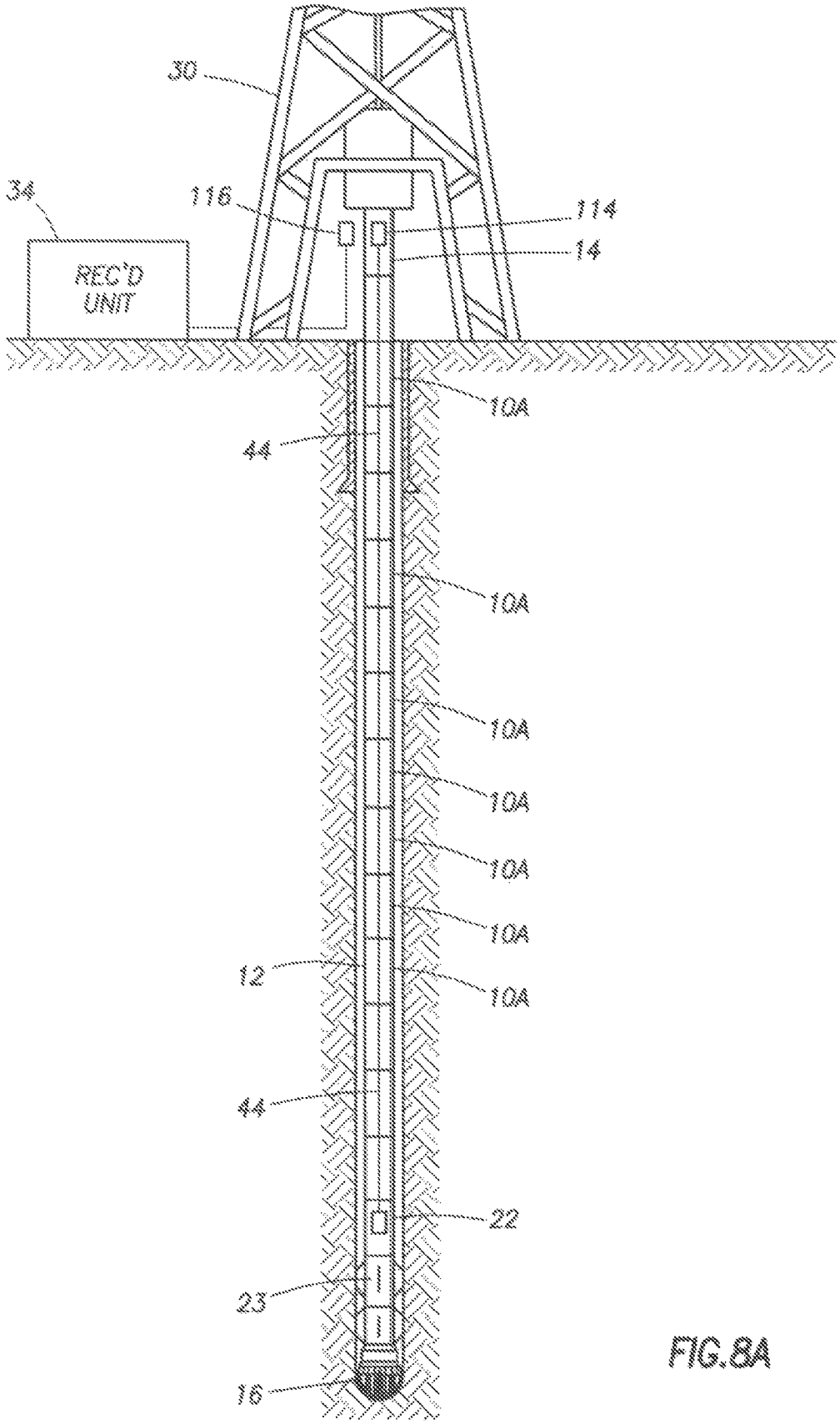
FIGS. 8A and 8B show an example of a drilling system having a cable link system.
Figure 8B:
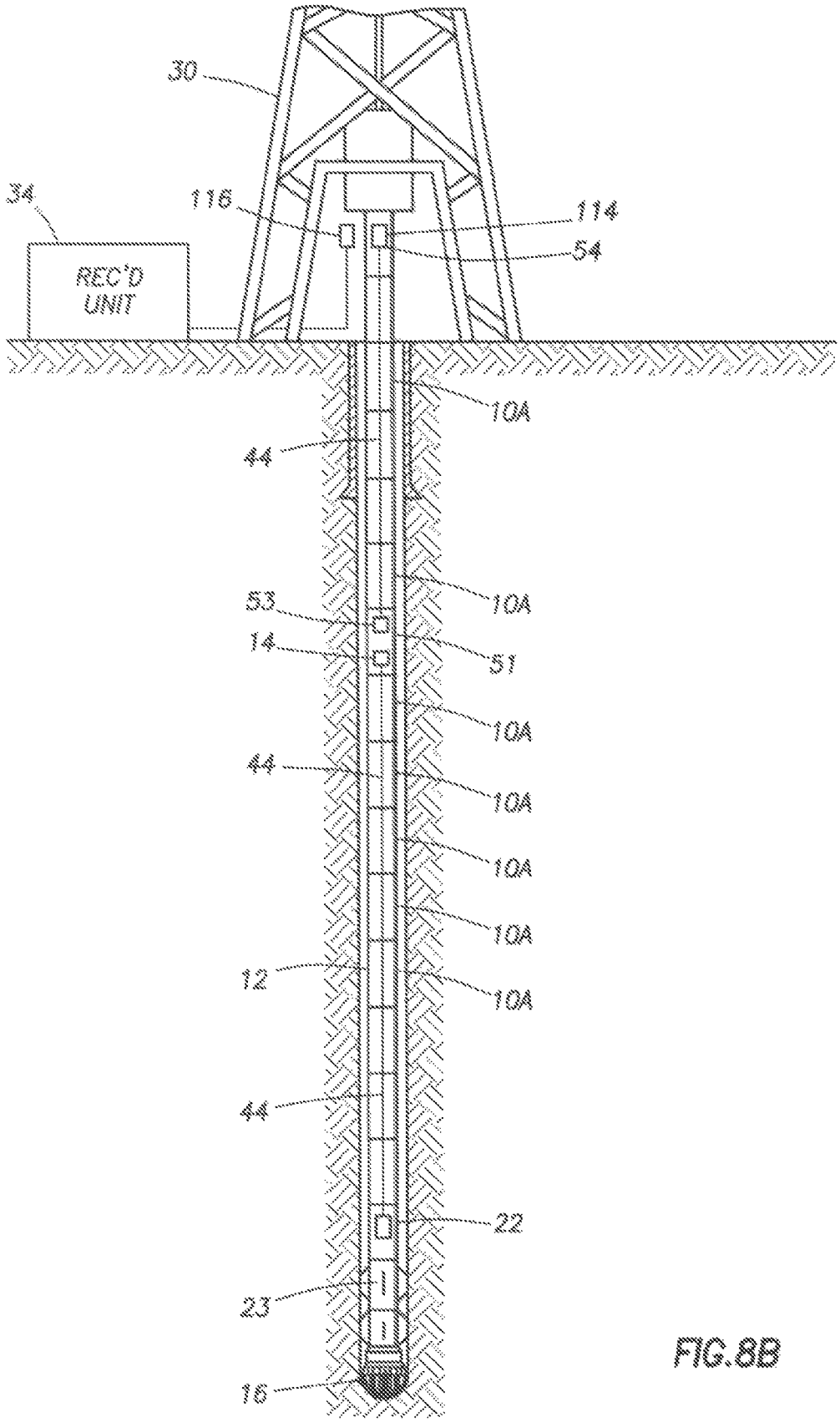

In addition, the second connector module 14 may be located in a position within the drill string, as shown in FIG. 8B. The second connector may form part of a sub 51 that include the second connector module 14 and a third connector module 53. The third connector module 53 may include a cable 44 that connects the third connector module 53 to a fourth connector module 54 near the surface. Any number of cables and connector modules may be used to span the distance between bottom hole assembly and the surface. In some examples, the cable link may be used to connect only selected portions of the drill string.

By using such a linking cable, it is possible to use conventional pipe joints 10A that do not include a signal communication channel in the manner of "wired" drill pipe. Thus, the examples shown in FIGS. 8A and 8B may eliminate the need to use wired drill pipe for high bandwidth wellbore signal communication.

Another possible benefit of the arrangement shown in FIGS. 8A and 8B is that the entire cable link or one segment of a cable link system may be quickly removed from the drill string by spooling, such as on a winch or similar device, so that the pipe string may be removed from the wellbore just as any ordinary pipe string. Furthermore, in the event the any linking cable 44 becomes damaged or otherwise fails to function, the linking damages cable 44 may be quickly and easily replaced by removal as explained above and subsequent inserting and latching a replacement linking cable. Such replacement linking cable would typically include a first connector as explained above at the lower end thereof and a second connector as explained above at its upper end.

Examples of a cable link according to the invention enables use of conventional drilling tools such as jars, stabilizers and collars in a wired drill pipe system without the need to specially equip such drilling tools with electrical and/or optical signal channels. Other embodiments of a cable line according to the invention may enable signal communication at relatively high bandwidth without the need to provide wired drill pipe.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A cable link, comprising:

a first link connector in signal communication with at least one sensor in a drill string and coupled to the drill string;

a second link connector spaced apart from the first link connector and in signal communication with a telemetry system, the second connector link coupled to the drill string; and a linking cable having signal connectors at each end thereof, the linking cable having at least one of an electrical conductor and an optical fiber therein, the signal connectors each configured to latch proximate a respective one of the first and second link connector;

wherein the linking cable has a length selected to enable winding to provide frictional contact between the linking cable and an interior wall of a part of the drill string disposed between the first link connector and the second link connector.

2. The cable link of claim 1, further comprising at least one electromagnetic induction coil in each of the link connectors and corresponding signal connectors.

3. The cable link of claim 1, wherein the linking cable comprises armored electrical cable having at least one insulated electrical conductor therein.

4. The cable link of claim 1, wherein the drill string comprises at least one drilling tool disposed between the first link connector and the second link connector, the at least one drilling tool having no signal communication element therein.

5. The cable link of claim 1, wherein at least one of the first and second link connectors comprises a latch for receiving a respective one of the first and second signal connectors, the latch including a landing having a keyed opening therein for receiving therein a corresponding feature on the respective signal connector, the landing including at least one passage therethrough for drilling fluid.

6. The cable link of claim 1, wherein one of the first and the second signal connectors include a fishing feature at an upper end thereof.

7. The cable link of claim 1, further comprising an optical coupling between the signal connectors and the link connectors.

8. The cable link of claim 1, wherein the telemetry system is a wired drill pipe system.

9. A telemetry system, comprising:

a first link connector in signal communication with at least one instrument coupled to a drill string disposed in a wellbore;

a second link connector coupled to the drill string and spaced apart from the first link connector, the second link connector in signal communication with equipment disposed at the Earth's surface; and a linking cable having signal connectors at each end thereof, the linking cable having at least one of an electrical conductor and an optical fiber therein, the signal connectors each configured to latch proximate a respective one of the first and second link connector;

wherein the linking cable has a length selected to enable winding to provide frictional contact between the linking cable and an interior wall of a part of the drill string disposed between the first link connector and the second link connector.

10. The telemetry system of claim 9 further comprising at least one electromagnetic induction coil in each of the link connectors and corresponding signal connectors.

11. The telemetry system of claim 9 wherein the linking cable comprises armored electrical cable having at least one insulated electrical conductor therein.

12. The telemetry system of claim 9 wherein at least one of the first and second link connectors comprises a latch for receiving a respective one of the first and second signal connectors, the latch including a landing having a keyed opening therein for receiving therein a corresponding feature on the respective signal connector, the landing including at least one passage therethrough for drilling fluid.

13. The telemetry system of claim 9 wherein one of the first and the second signal connectors include a fishing feature at an upper end thereof.

14. The telemetry system of claim 9 wherein the means for communicating comprises an optical coupling.

15. The telemetry system of claim 9 further comprising at least one slip ring connector coupled to the drill string for providing the second link connector with the signal communication to the equipment at the Earth's surface.

16. The telemetry system of claim 9 further comprising a first wireless transceiver coupled to the drill string proximate the second link connector and in signal communication therewith, and a second wireless transceiver in signal communication with the first wireless transceiver and the equipment at the Earth's surface, the first and second wireless transceivers providing the signal communication between the second link connector and the equipment at the Earth's surface.

17. The telemetry system of claim 9 wherein the first link connector is disposed proximate the bottom of the drill string and the second link connector is disposed proximate a drilling unit supporting the drill string from the Earth's surface.

18. The telemetry system of claim 9, further comprising:

a third link connector in signal communication with the second link connector;

a fourth link connector coupled to the drill string and spaced apart from the third link connector, the fourth link connector in signal communication with equipment disposed at the Earth's surface; and a second linking cable having signal connectors at each end thereof, the linking cable having at least one of an electrical conductor and an optical fiber therein, the signal connectors each configured to latch proximate a respective one of the third and fourth link connector.

* * * * *